US005904111A

United States Patent [19]

Frigard

[11] Patent Number: 5,904,111

[45] Date of Patent: May 18, 1999

[54] TRIMARANS WITH REMOVABLE BEAMS CONFIGURATIONS AND STEERING WHEEL ASSEMBLIES

[75] Inventor: Charles Raymond Frigard, Mound, Minn.

[73] Assignee: North Star Marine, Inc., Mound, Minn.

[21] Appl. No.: 08/835,305

[22] Filed: Apr. 7, 1997

Related U.S. Application Data

[63] Continuation-in-part of application No. 08/511,042, Aug. 3, 1995, Pat. No. 5,617,805.

[51] Int. Cl.[6] ..... B63B 1/14

[52] U.S. Cl. ..... 114/39.28; 114/61.17; 114/144 R; 114/162

[58] Field of Search ..... 114/283, 284, 114/123, 61, 39.1, 144 R, 162, 39.28; 440/26–31; 74/486, 492

[56] References Cited

U.S. PATENT DOCUMENTS

| | | | |
|---|---|---|---|
| D. 289,392 | 4/1987 | Gary et al. . | |
| D. 324,021 | 2/1992 | Walker . | |
| 1,710,625 | 4/1929 | Kapigian . | |
| 3,045,263 | 7/1962 | Blachly . | |
| 3,143,992 | 8/1964 | Beams | 440/29 |
| 3,212,109 | 10/1965 | Roman . | |
| 3,291,091 | 12/1966 | Koenig . | |
| 3,450,084 | 6/1969 | Gerbracht | 114/283 |
| 3,792,676 | 2/1974 | Craft | 114/123 |
| 3,802,366 | 4/1974 | Mankawich . | |
| 3,929,085 | 12/1975 | Mason | 114/123 |
| 3,960,102 | 6/1976 | Davy . | |
| 4,172,426 | 10/1979 | Susman . | |
| 4,294,184 | 10/1981 | Heinrich . | |
| 4,548,291 | 10/1985 | Tanaka et al. | 74/492 |
| 4,688,504 | 8/1987 | Sulz et al. | 114/283 |
| 4,730,570 | 3/1988 | Harris . | |
| 4,807,551 | 2/1989 | Ace . | |
| 4,813,366 | 3/1989 | Elder . | |
| 4,836,120 | 6/1989 | Murphy . | |
| 4,878,447 | 11/1989 | Thurston . | |
| 5,031,557 | 7/1991 | Farrier . | |
| 5,189,974 | 3/1993 | Masters . | |
| 5,235,925 | 8/1993 | Farrier . | |
| 5,243,924 | 9/1993 | Mann . | |
| 5,377,607 | 1/1995 | Ross . | |
| 5,392,726 | 2/1995 | Benze . | |

FOREIGN PATENT DOCUMENTS

| | | |
|---|---|---|
| 2662658 | 12/1991 | France . |
| 2352908 | 4/1975 | Germany . |

*Primary Examiner*—Sherman Basinger
*Attorney, Agent, or Firm*—Dorsey & Whitney LLP

[57] ABSTRACT

An improved trimaran is provided. The trimaran includes a main section, multiple floats, a sail assembly and a set of beams that are used to removably position the floats a certain distance from the main section. The center section includes a centerboard or daggerboard assembly, steering assembly, cockpit area, bulkhead areas and mast receiving area. The controls for the centerboard assembly and steering assembly are centrally located in the front portion of the cockpit area and the cockpit area is positioned between the bulkhead areas. The trimaran is designed to have a car-like steering configuration and in one embodiment interchangeable beams to vary the width of the trimaran, depending on whether the user wishes to sail the trimaran or transport it to another location by for example, loading it on a trailer. In another embodiment having removable beams, the beams have adjustable settings so that the height of the floats relative to the center section can be varied.

14 Claims, 16 Drawing Sheets

20
28
2
42
48
52
26
50
44
54
24
46
22
40
60
56
58
38
36
24
26
2

252
251
242
202
200
34
130
122
50
124
54
36
56
70
80
168
176
154
174
172
170
96
164
166
180
182
206
104
100
86
84
96
220
224
226
90
94
106
108
92
52
110
128
126
216
214
210
212
260
258
144
38
278
24
281
280
282
264
262
266
268
270
272
160
162
152
158
134
132
136
138
140
142
143
228
230
234

608
600
606
604
606
606
612
606
610
602
604

623
613
625
680
613
636
662
638
628
637
666

TRIMARANS WITH REMOVABLE BEAMS CONFIGURATIONS AND STEERING WHEEL ASSEMBLIES

This application is a continuation-in-part of U.S. application Ser. No. 08/511,042 filed Aug. 3, 1995 now U.S. Pat. No. 5,617,805.

FIELD OF INVENTION

The present invention relates to sailboats, and more particularly to an improved multi-hull sailboat.

BACKGROUND OF THE INVENTION

Multi-hull sailboats have been in use worldwide for centuries. Multi-hull sailboats include sailboats with two hulls which are now referred to as catamarans and sailboats with three hulls which are now referred to as trimarans. Trimarans typically comprise a main hull and two side floats or pontoons positioned one on each side of, and a distance from, the main hull to improve the stability of the sailboat.

While there are a variety of multi-hull sailboat designs commercially available, there are some inadequately addressed problems. Many of these problems stem from the fact that the width of most multi-hull sailboats is quite large compared to that of single hull boats. Although this increased width improves their stability in water, it makes them difficult to maneuver and transport by trailer or the like from one location to another when taken out of the water.

Another problem is that most multi-hull sailboats cannot be disassembled and those that can be disassembled cannot be disassembled quickly and easily.

A further problem is that multi-hull sailboats take up considerable space at piers and docks.

A still further problem with multi-hull sailboats is that smaller designs, such as those under twenty feet in length, do not provide any real or comfortable seating arrangements for the users and there is limited or no storage areas which can result in belongings being lost overboard.

Another problem, which is applicable to sailboats in general, and to multi-hull boats as well, is that they can be difficult to learn how to sail.

SUMMARY OF THE INVENTION

The present invention relates to a trimaran that includes a car-like steering system and interchangeable floats or pontoon supports to vary the width of the trimaran, depending on whether the user wishes to sail the trimaran, transport it to another location by, for example, loading it on a trailer, or otherwise maneuvering it out of water.

More specifically, the trimaran of the present invention includes a main or center section, multiple floats, a sail assembly and a set of generally lateral beams that are used to selectively position the floats a desired distance from the main section. The set of beams include beams of different lengths that enable the user to choose a subset of the set of beams to construct a trimaran of varying width.

The center section includes a centerboard or daggerboard assembly, steering assembly, cockpit area, bulkhead areas and mast receiving area. The controls for the centerboard assembly and steering assembly are centrally located in the front portion of the cockpit area and the cockpit area is positioned between the bulkhead areas.

It is an object of the present invention to provide a trimaran that exhibits increased stability, while not adversely effecting its speed.

It is another object of the present invention to provide a trimaran that can be quickly and easily reconfigured by changing the distance between the floats and the main hull, thereby substantially increasing or reducing the width of the trimaran.

It is still another object of the present invention to provide a trimaran that can be quickly and easily disassembled and reassembled so that the center section and two floats can be transported and/or stored in sections.

It is yet another object of the present invention to provide a relatively small trimaran that includes seating arrangements and storage areas for the users.

It is a further object of the present invention to provide a trimaran that provides a steering wheel and seat in a car-like relationship and controls that are within easy reach of the user when steering the trimaran.

It is still another object of the present invention to provide a system for varying the height of the floats relative to the main hull, so that the user can achieve the feel of sailing a monohull sail boat as his or her abilities increase or as sea conditions permit.

It is still yet another object of the present invention to provide a trimaran that has adjustable beams that enables the user to sail it with either one, two or three hulls in the water as a boat is generally able to sail faster with fewer hulls in the water.

Other objects and advantages of the present invention will become more fully apparent and understood with reference to the following specification and to the appended drawings and claims.

DETAILED DESCRIPTION OF THE PREFERRED EMBODIMENT

Figure 1:
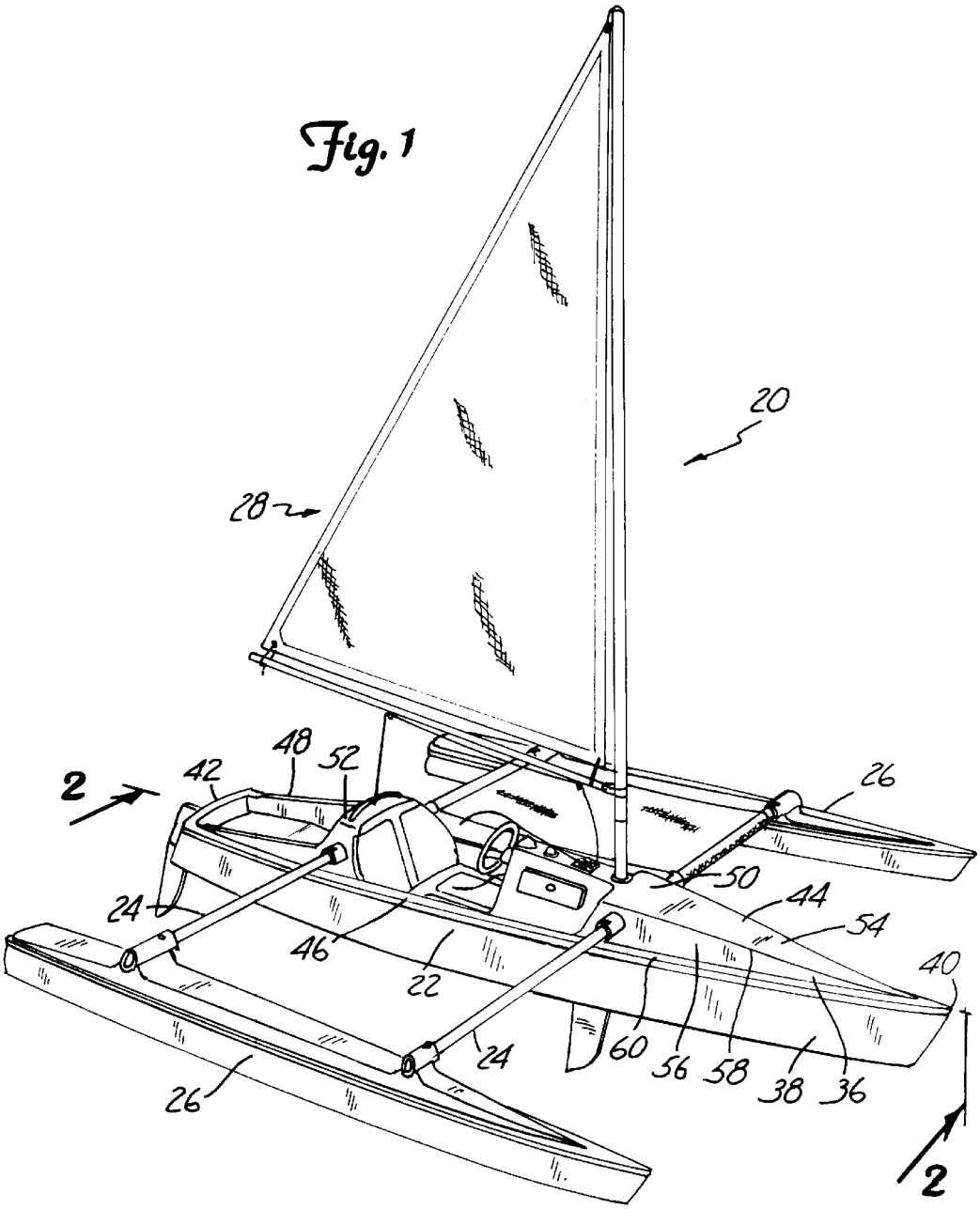
FIG. 1 is a isometric view of a trimaran incorporating the improvements of the present invention.
Figure 2:
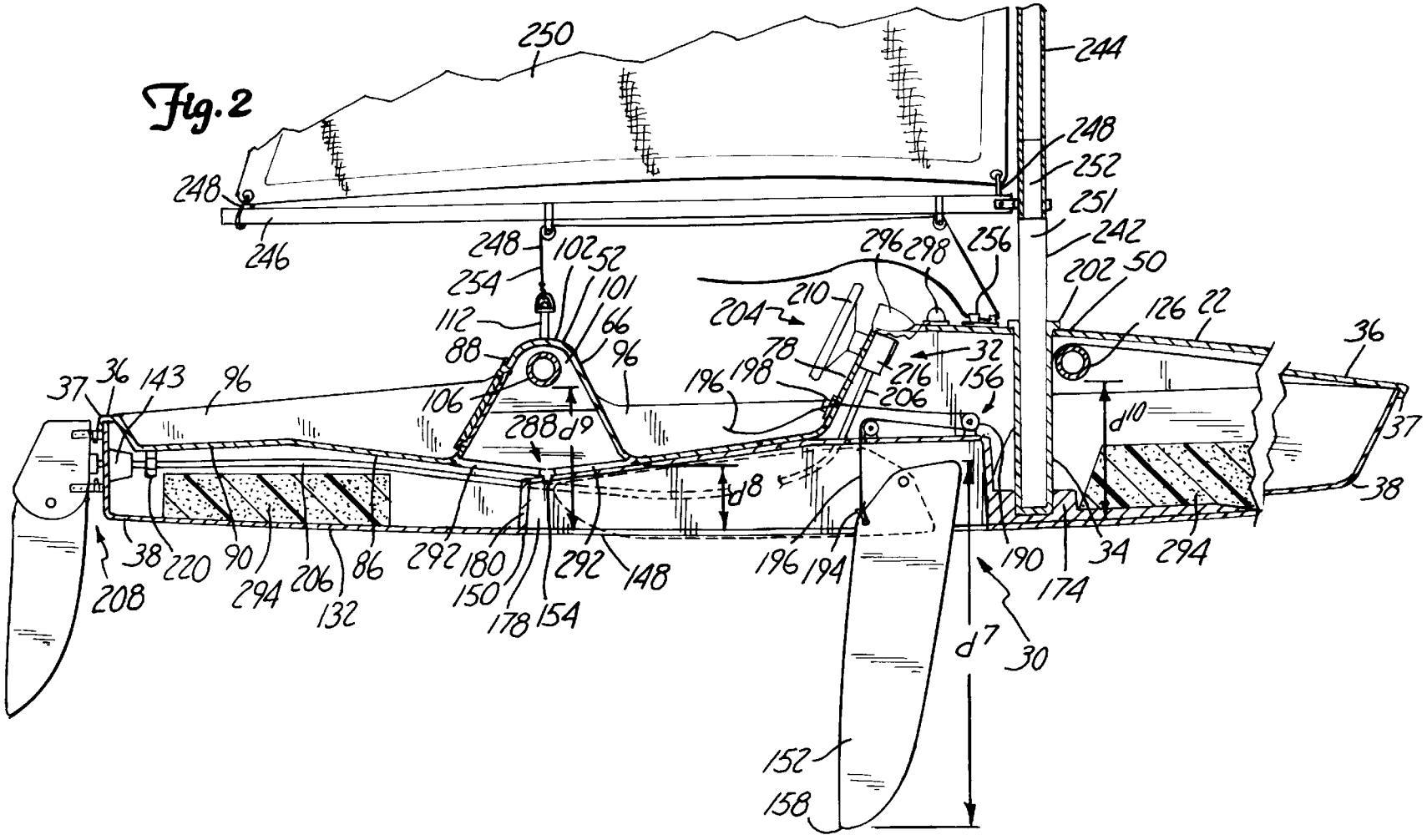
FIG. 2 is a view, partially in section with the front end broken apart, as viewed along the section line 2—2 of FIG. 1, showing portions of the steering assembly, keel assembly and sail assembly that are enclosed within the main hull and main deck of the present invention.

Reference is first made to FIG. 1 showing a trimaran 20 embodying the present invention. The trimaran 20 broadly includes a center section 22, a set of beams 24, two floats 26, and a sail assembly 28. Although FIG. 1 depicts two beams 24, the present invention is intended to encompass interchangeable subsets of two or more beams 24 wherein the length of the beams 24 comprising a particular subset is the same, but the length of the beams 24 comprising one subset may vary from the length of the beams 24 comprising a second subset, as will be described in more detail below. As best seen in FIG. 2, the center section 22, includes a keel assembly 30, a steering assembly 32 and, mast sleeve 34.

Figure 3:
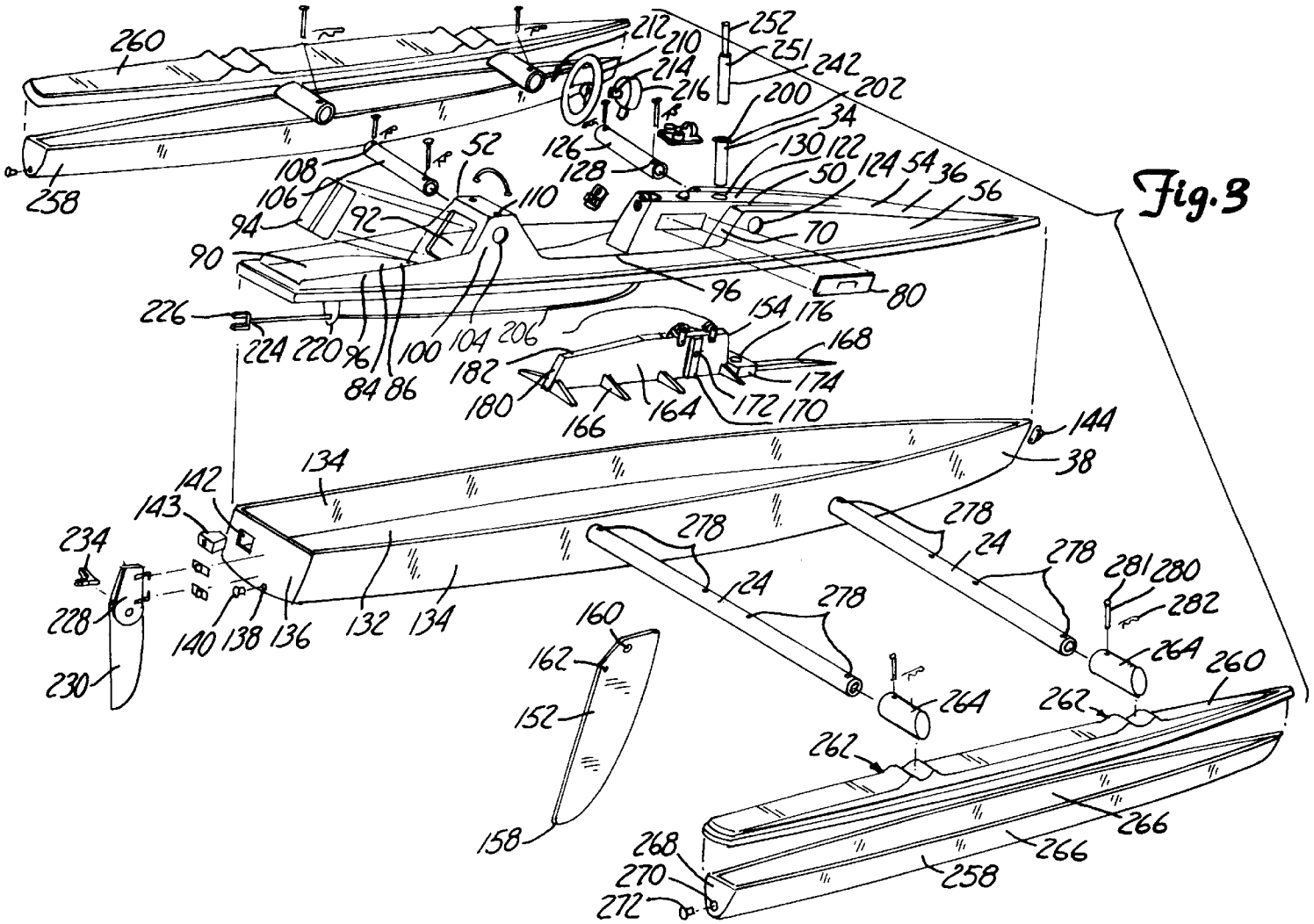
FIG. 3 is an exploded view of a trimaran incorporating the improvements of the present invention.

As depicted in FIG. 3, the center section 22 further includes a main deck 36 and main hull 38. The main deck 36 is bonded to the main hull 38 with a methacrylate adhesive, which is commercially available. Plexus is a brand name of a type of methacrylate adhesive which is sold by I.T.W. Adhesives, Danvers, Me. Various other commercially available marine adhesives can be used as well, but unless otherwise mentioned marine adhesive is meant to mean a methacrylate adhesive. As illustrated in FIG. 2, the main deck 36 has a lip 37, that overlaps a portion of the main hull 38. The adhesive is applied to the inside of the lip 37 where it contacts the hull 38.

Returning to FIG. 1, the main deck 36 has a front or bow section 44, a center or mid-ship section 46 and a rear or aft section 48. A front end 40 and a rear end 42 define the forwardmost and rearwardmost ends of the deck 36. A front bulkhead area 50 defines the transition between the bow section 44 and the mid-ship section 46 and a rear bulkhead area 52 defines the transition between the mid-ship section 46 and the aft section 48.

The bow section 44 of the main deck 36 is molded to form a bow cover 54 and bow sides 56 having top transition edges 58 and bottom side edges 60. The height of the bow sides 56 is greater adjacent the front bulkhead area 50 than at the front end 40. The difference in height is attributable to a gradual increase in the height of the top transition edges 58 from the front end 40 of the main deck 36 to the front bulkhead area 50.

Figure 4:
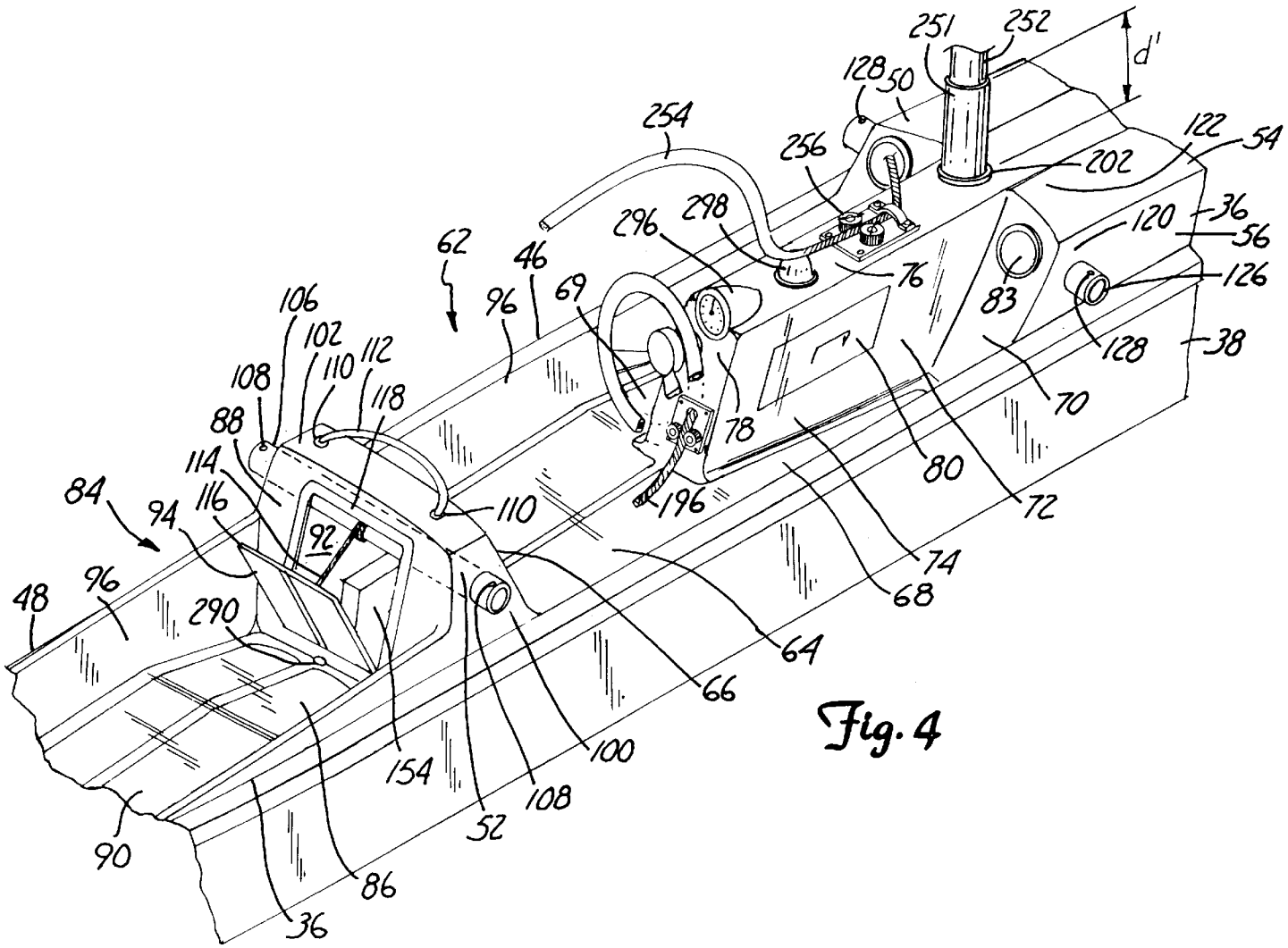
FIG. 4 is a fragmentary isometric view of the central and rear portions of the main hull and main deck with the rear hatch pulled open.
Figure 8:
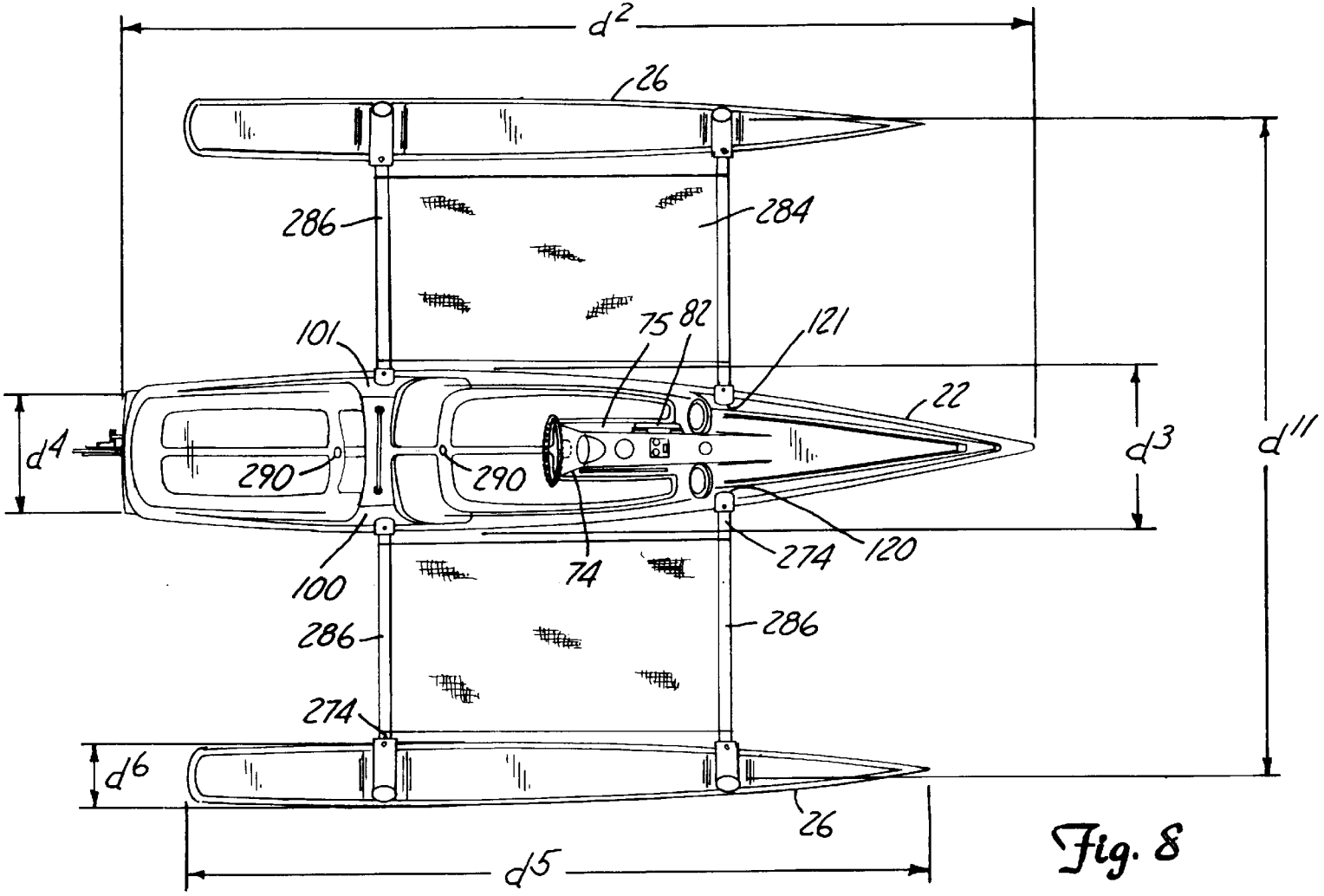
FIG. 8 is a top plan view of a trimaran incorporating the improvements of the present invention assembled with long beams for sailing.

As depicted in FIG. 4, the mid-ship section 46 of the main deck 36 is molded to form a driver's cockpit area 62 having a driver's seat 64, a driver's back support 66, two driver's leg rests 68, 69, two foot support panels 70 and a steering wheel binnacle 72. The steering wheel binnacle 72 includes a right and left side panel 74, 75, a top panel 76 and steering wheel panel 78. Each driver's leg rest, 68, 69 extends along one side of a side panel 74, 75, respectively. The right panel 74 has a hinged binnacle locker door 80, and, as seen in FIG. 8, the left panel has a hinged stereo cover 82. Stereo speakers 83 are mounted on the foot support panels 70.

As illustrated in FIGS. 2–4, the aft section 48 of the main deck 36 is molded to form a passenger area 84 having a passenger's seat 86, passenger's back support 88 and leg rest 90. The passenger's back support 88 includes a rear hatch opening 92 and a rear hatch 94. Both the driver's cockpit area 62 and passenger area 84 include molded splash rails 96.

As further illustrated in FIGS. 2–4, the rear bulkhead area 52 is defined by the driver's back support 66, the passenger's back support 88, a right and left rear bulkhead wall 100, 101, respectively, and a rear bulkhead crown 102. With reference to FIG. 3, each bulkhead wall 100, 101 has an aperture 104, for receiving a rear sleeve 106. The rear sleeve 106 fits within the apertures 104 and is glued in place with a marine adhesive, which also forms a watertight seal. In the preferred embodiment, the ends of the rear sleeve 106 extend outwardly beyond each bulkhead wall 100, 101 and transversely to the longitudinal axis of the boat approximately 3 inches. Each end of the rear sleeve 106 has two bolt holes 108 having a central axis. The bolt holes 108 are approximately ¾ of an inch from each end of the rear sleeve 106. The bulkhead crown 102 also has two apertures 110 through which two ends of a rear bulkhead rope 112 pass and which are retained by knotting both ends of the rope 112 inside the rear bulkhead area 52. As shown in FIG. 4, the rear hatch 94 is biased against the passenger's back support 88 by an elastic cord 114 connected to the rear sleeve 106 and held in position by the complementary outside edge 116 of the rear hatch 94 and edge 118 defining the rear hatch opening 92.

With continued reference to FIGS. 2–4, the front bulkhead area 50 is partially defined by the foot support panels 70 and a mast sleeve 34. The front bulkhead area 50 includes a right and left front bulkhead wall 120, 121, respectively and a front bulkhead cover 122. Each front bulkhead wall 120, 121 has an aperture 124 for receiving a front sleeve 126. The front sleeve 126 fits within the apertures 124, and is glued in place with a marine adhesive, which also forms a watertight seal. In the preferred embodiment, the ends of the front sleeve 126 extend outwardly beyond each bulkhead wall 120, 121 and transversely to the longitudinal axis of the boat approximately 3 inches. Each end of the front sleeve 126 has two bolt holes 128 having a central axis. The bolt holes 128 are approximately ¾ of an inch from each end of the front sleeve 126. The front bulkhead cover 122 has a mast sleeve aperture 130. The front bulkhead walls 120, 121 and front bulkhead cover 122 are continuous with the bow sides 56 and bow cover 54, respectively, extending toward the bow section 44 from the steering wheel binnacle 72, top panel 76 and foot support panels 70 to a point just forward of the front sleeve 126.

Figure 5:
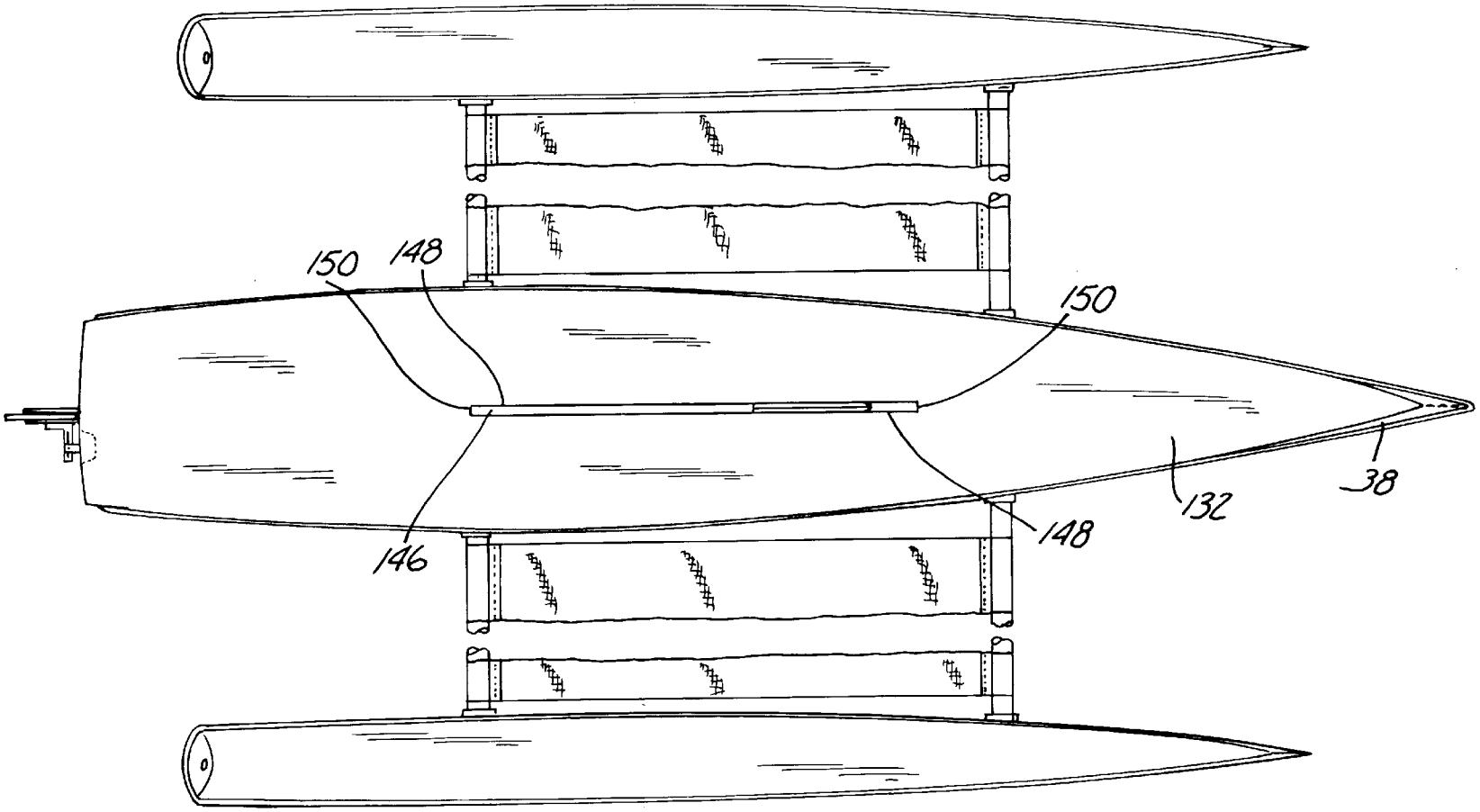
FIG. 5 is a bottom elevational view of the trimaran incorporating the improvements of the present invention with a portion of the beams and tarps removed.

Referring to FIG. 3, the main hull 38 includes a bottom 132, two sides 134 and a transom 136. The transom 136 includes a circular drain hole 138, a drain hole plug 140, a rectangular steering cable exit hole 142, and a steering cable exit box 143. Adjacent the front end 40 of the main deck 36, where the two sides 134 meet to form a common edge, a bow eye 144 is attached to the main hull 38. As shown in FIG. 5, the main hull 38 bottom 132 includes a narrow elongated slot 146 defined by two sides 148 and two ends 150 directly beneath the mid-ship section 46 of the main deck 36.

Figure 7:
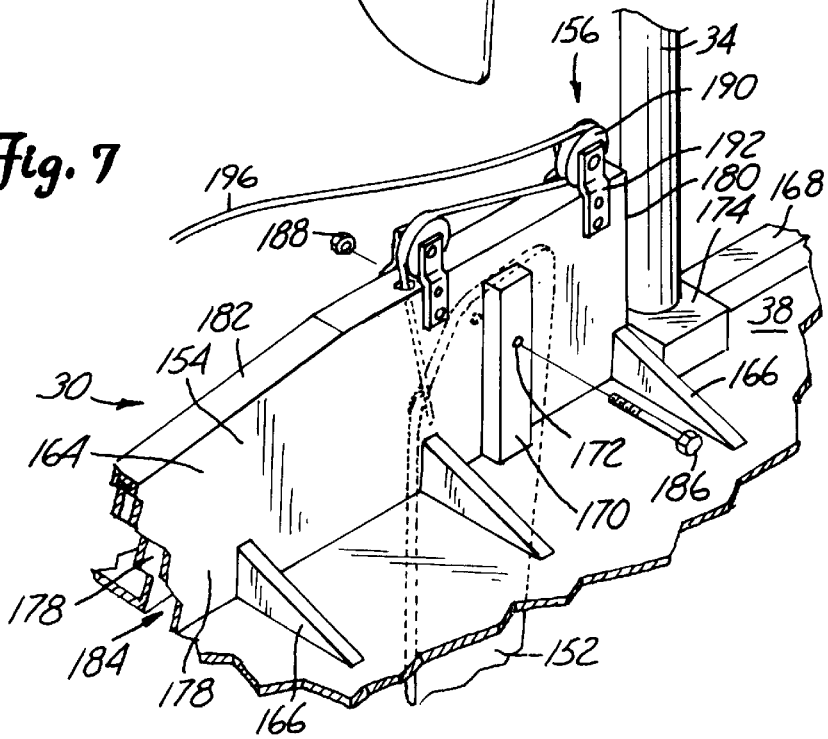
FIG. 7 is a fragmentary isometric view of a portion of the keel and sail assembly.

As depicted in FIGS. 2, 3 and 7, the keel assembly 30 includes a centerboard 152, a centerboard housing 154 and a pulley assembly 156. The centerboard 152 includes a free end 158, a pivot hole 160 and a clasp hole 162. The centerboard housing 154 includes a trunk section 164, a plurality of transverse support ribs 166, a longitudinal support rib 168, two pivot posts 170 each having an aperture 172, and a rectangular mast step 174. The mast step 174 is a transverse extension of the longitudinal rib 168 and has a central mast sleeve receptacle 176. The centerboard truck section 164 includes two sides 178, two ends 180, a top 182, and a bottom opening 184. The bottom opening 184 is defined by the free edges of the two sides 178 and two ends 180.

As shown in FIGS. 2 and 7, the centerboard 152 is pivotally attached to the trunk section 164 by a bolt 186 that passes through a first aperture 172 in one pivot post 170, through a pivot hole 160 in the centerboard 152, and finally through a second aperture 172 in the second pivot post 170. A fastening member 188 such as a nut, a clasp, a cotter pin or the like retains the bolt 186 in place. The centerboard housing 154 is glued to the bottom of the main hull 38 with a marine adhesive whereby the sides 178 and the ends 180 of the trunk section 164 are positioned above the sides 148 and ends 150 of the slot 146, as best depicted in FIG. 2. The keel pulley assembly 156 includes two sheaves 190, two sheave supports 192, a D-ring 194, a centerboard cable 196, and centerboard jam cleat 198, which is shown in detail in FIG. 4.

As illustrated in FIGS. 2 and 3, the mast sleeve 34 is cylindrical with only one open end 200. Adjacent the open end 200, the mast sleeve 34 includes a flange 202. With the open end 200 up, the mast sleeve 34 is fitted into the mast sleeve aperture 130 and into the mast sleeve receptacle 176. The edge defining the mast sleeve aperture 130 is bonded to the mast sleeve 34 adjacent the flange 202 and the mast sleeve 34 is bonded to the mast sleeve step 174 using a marine adhesive.

Figure 6:
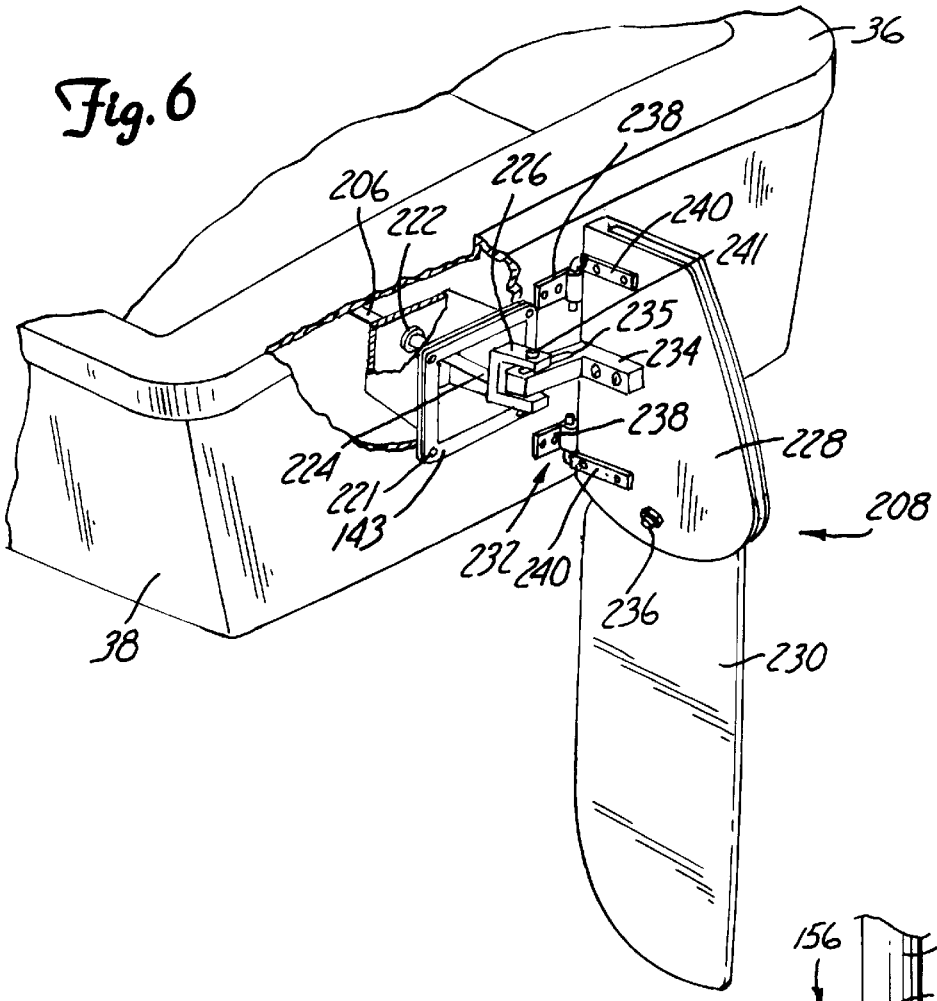
FIG. 6 is a fragmentary isometric view of the rear end of the main deck and main hull showing the rudder assembly and with a portion of the main hull and cable exit box removed showing the steering cable passing through the rubber seal retained by the cable exit box.

Referring to FIGS. 2 and 6, the steering assembly 32 includes a steering wheel assembly 204, steering cable 206, and rudder assembly 208. Also referring to FIG. 3, the steering wheel assembly 204 includes a steering wheel 210 connected by a pinion nut 212 to a pinion shaft 214. The pinion shaft 214 enters a steering gear box 216 and the steering cable 206 exists the gear box 216 traveling under the main deck 36 through the main hull 38 to the rear end 42 and through the rectangular steering cable exit box 143. The steering wheel assembly 204 is mounted to the steering wheel panel 78 adjacent the top panel 76. This type of steering gear box 216 is commercially available and in the preferred embodiment of the present invention the gear box used is manufactured and sold by Morse Controls of Hudson, Ohio under its "Command 230" model name. However, various other commercially available steering gear boxes, such as Teleflex, model 113359, manufactured by West Marine of Watsonville, Calif., will function as well.

The steering cable 206 is attached to main deck 36 under the passenger leg rest 90 by a cable bracket 220. The steering cable exit box 143, through which the steering cable 218 exits the main hull 38, is attached to the main hull 38 with four removable screws 221 and a removable marine adhesive which is commercially available. 3M Polyurethane Marine Adhesive/Sealant, 5200 White, is a brand of a type of removable marine adhesive which is sold by Minnesota Mining & Manufacturing, St. Paul, Minn. Various other commercially available removable marine adhesives can be used as well. To create a water tight seal, the steering cable 206 is fitted with a rubber seal 222 where it passes through an aperture in the steering cable exit box 143. The outer periphery of the rubber seal 222 is attached to the steering cable exit box 143. The distal end 224 of the steering cable 218 is connected to a U-shaped bracket 226.

Figure 10:
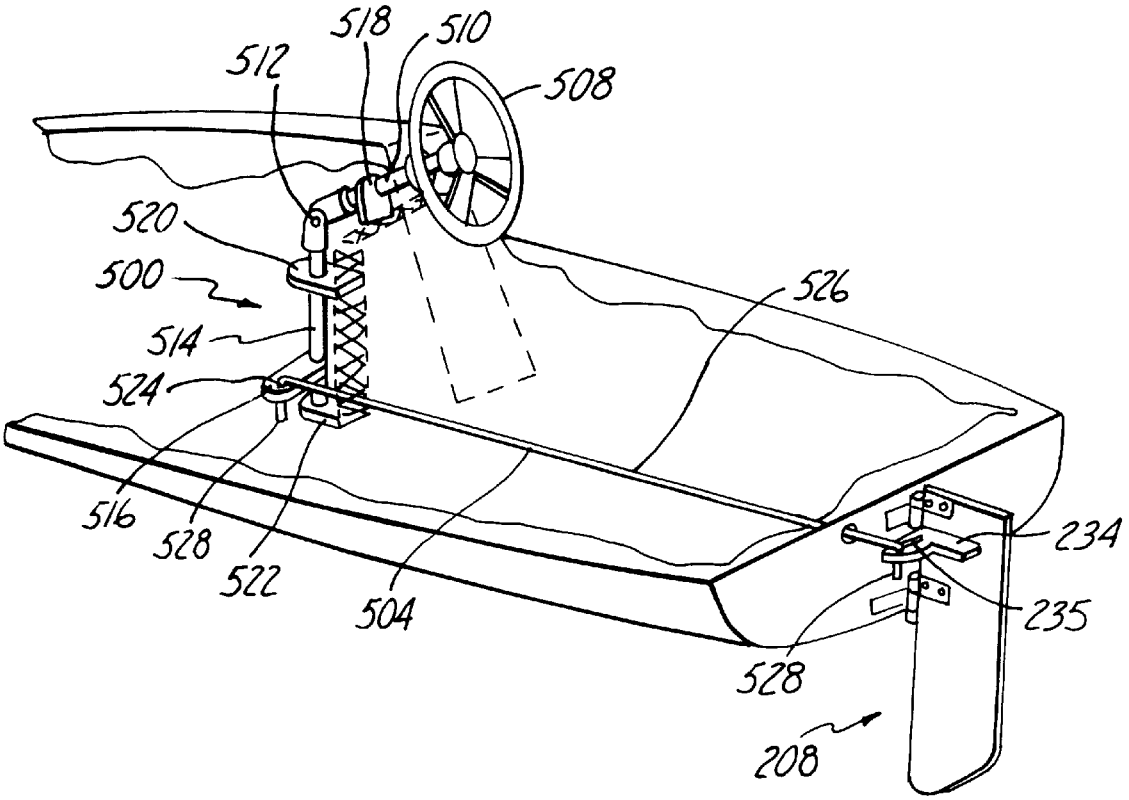
FIG. 10 is fragmentary isometric view of the rear end of the center section showing the rudder assembly and an alternate embodiment of the steering assembly with a portion of the deck supporting the steering assembly brackets shown in phantom.
Figure 11:
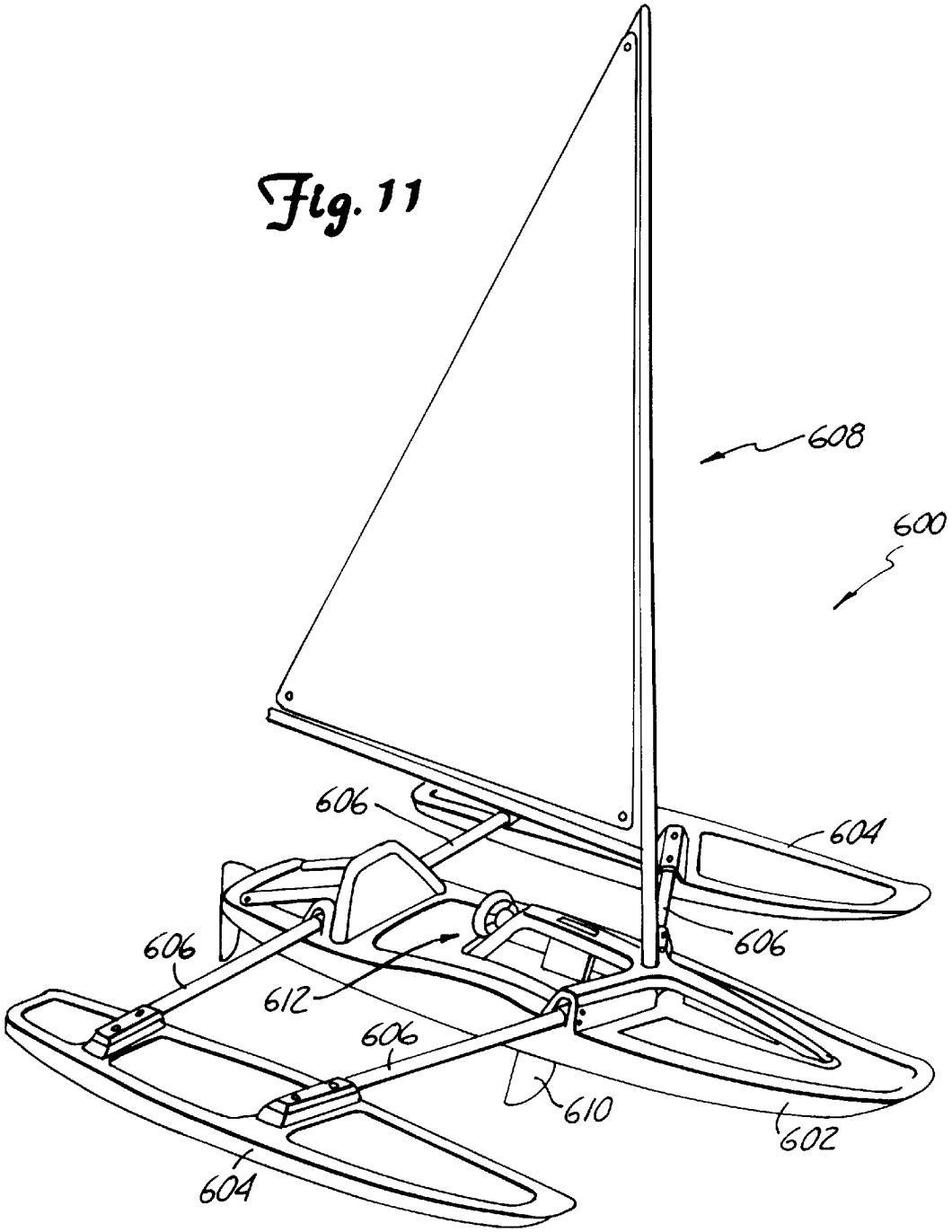
FIG. 11 is a isometric view of an alternate embodiment of a trimaran in accordance with the present invention.
Figure 12:
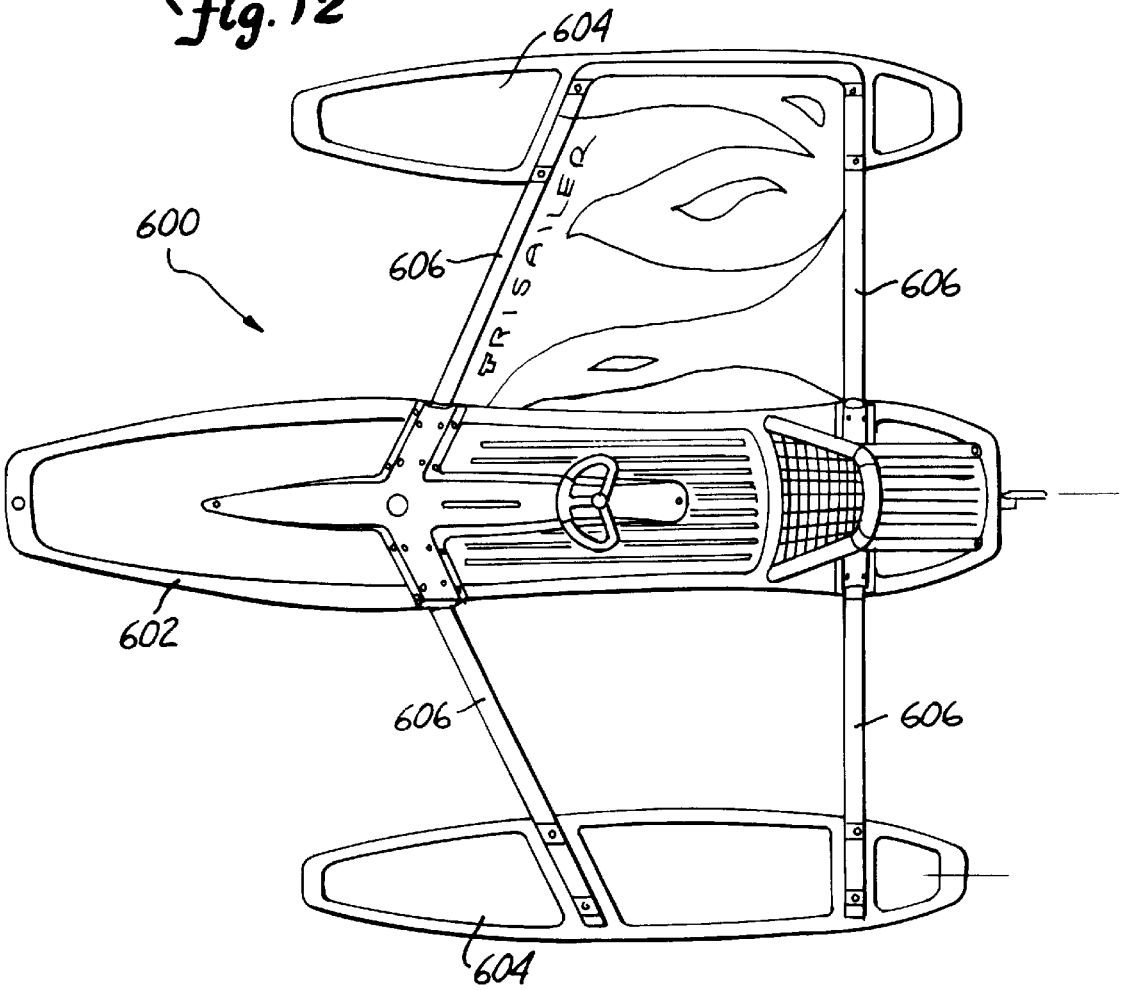
FIG. 12 is a top plan view of the trimaran of FIG. 11.
Figure 13:
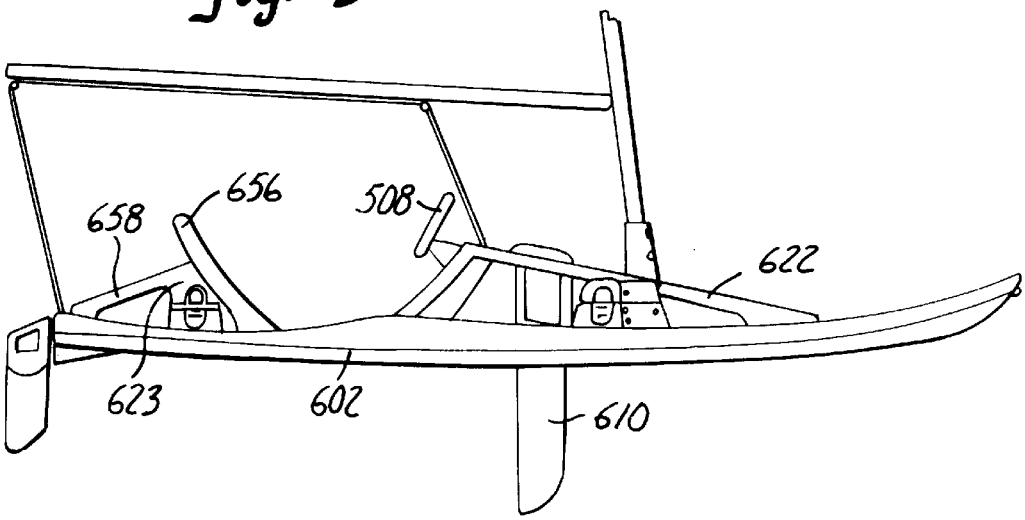
FIG. 13 is a side view of the trimaran of FIG. 11 with the beams, floats, and a portion of the sail assembly removed.

Referring to FIG. 10, an alternative steering assembly 32 includes a steering wheel assembly 500, a push/pull rod 504, and rudder assembly 208. In the preferred alternative embodiment, the steering wheel assembly 500 includes a steering wheel 508, a steering column 510, a universal joint 512, a vertical shaft 514, and a shaft bell crank 516. The steering wheel assembly 500 is supported and held in position within the main deck 36 and main hull 38 by two brackets and a plate; a column bracket 518, a vertical shaft bracket 520, and a shaft seat 522, respectively. The shaft bell crank 516 is fixedly attached to the vertical shaft 514 adjacent the shaft seat 522, and has an aperture 524. The push/pull rod 504 has a body portion 526 and two end portions 528 that have axes that are parallel to each other, and that are 90 degrees to the axis of the body portion 526. One end portion 528 fits in the aperture 524 of the shaft bell crank 516, and the second end portion 528 fits in the elongated slot 235 of the L-shaped bracket 234 of the rudder head 228 (as discussed below). It should be understood that a flexible cable could be used instead of a universal joint 512.

The rudder assembly 208 includes a rudder head 228, kick-up rudder 230, rudder hinge assembly 232 and L-shaped bracket 234 having an elongated slot 235. A bolt 236 pivotally attaches the kick-up rudder 230 to the head rudder 228. The head rudder 228 is hingedly attached to the transom 136 by the rudder hinge assembly 232 which includes two sets of gudgeon 238 and rudder pintles 240. The L-shaped bracket 234 is fastened to the left side of the rudder head 228 and the U-shaped bracket 226 is connected to the L-shaped bracket 234 by a bolt 241 that passes through the elongated slot 235. Fastening members hold the bolts 236 and 241 in place.

As illustrated by FIG. 2, the sail assembly 28 includes a mast trunk 242, mast 244, boom 246 rigging 248 and sail 250. The mast trunk 242 consists of an outer sleeve 251 and an inner sleeve 252. The mast trunk 242 outer sleeve 251 has an outside diameter slightly smaller than the inside diameter of the mast sleeve 34 and in the preferred embodiment the outer sleeve 251 extends above the mast sleeve 34 approximately 18 inches as depicted by $d^1$ in FIG. 4. The mast trunk 242 inner sleeve 252 has an outside diameter slightly smaller than the inside diameter of the mast 244. The mast trunk 242 outer sleeve 251 and mast 244 have substantially the same diameter. Although the mast trunk 242 is not shown in section, it should be understood that the outer sleeve 251 and inner sleeve 252 are tubular, thin-wall members like the mast sleeve 34 and mast 244. The inner sleeve 252 is approximately 20 inches in length and approximately 10 inches of the inner sleeve 252 extend into the top portion of the outer sleeve 251 and 10 inches extend above the top portion of the outer sleeve 251. The portion of the inner sleeve 252 that extends into the outer sleeve 251 is bonded thereto with a marine adhesive.

The rigging 248 includes a main sheet rope 254. One end of the main sheet rope 254 is connected to rear bulkhead rope 112 and the other end passes through a main sheet jam cleat 256, which is attached to the top panel 76 of the steering wheel binnacle 72 and which is best shown in FIG. 4.

With reference to FIG. 3, both floats 26 include a float hull 258 and float deck 260. Like the center section 22, in the preferred embodiment the float deck 260 is bonded to the float hull 258 with the methacrylate adhesive known as Plexus manufactured by I.T.W. Adhesives. However, various other marine adhesives will function as well. Each float deck 260 includes two molded protrusions 262 having a generally semicircular inner surface, each adapted for receiving one float sleeve 264. The float sleeves 264 are bonded to the protrusions 262 with a marine adhesive. Each float hull 258 includes two sides 266 and a transom 268. Each transom 268 includes a circular drain hole 270 and drain hole plug 272.

Figure 9:
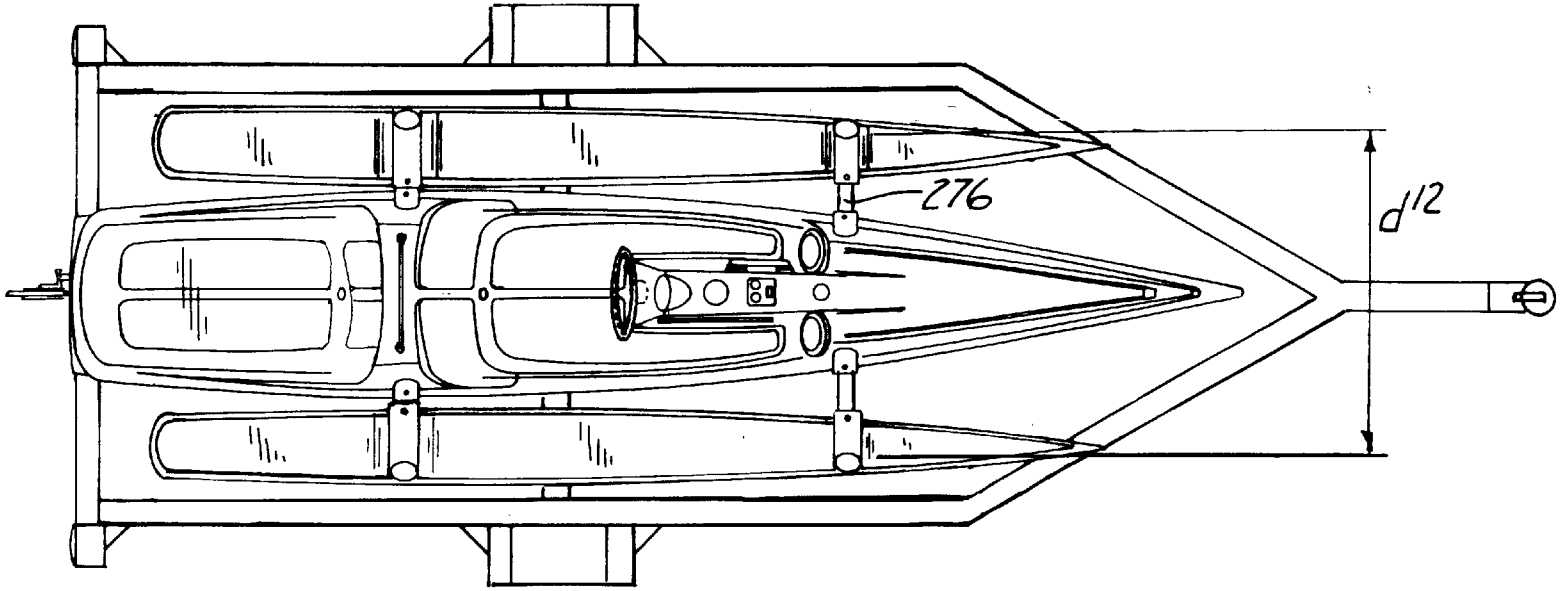
FIG. 9 is a top plan view of a trimaran incorporating the improvements of the present invention assembled with short beams and loaded on a trailer.

In the preferred embodiment of the present invention, the set of beams 24 includes two long beams 274, as depicted in FIG. 8, and two-short beams 276, as depicted in FIG. 9. Each beam 24 has four sets of holes 278 through both sides of each beam 24 as shown with the long beams 274 in FIG. 3. Each set of holes 278 has a central axis. In the preferred embodiment, one set of holes 278 is approximately 4 inches from the end of each beam 24 and another set of holes 278 is 13¾ inches on either side of the center point of each beam 24. Either the two long beams 274 or the two short beams 276 can be used to connect the floats 26 to the main deck 36, but one long beam 274 is not to be used with one short beam 276. Pins 280 having upper heads 281 are used to retain the beams 24 in rear sleeve 106, front sleeve 126 and float sleeves 264. Cotter pins 282 are used in the preferred embodiment to hold the pins 280 in place.

As seen in FIGS. 1 and 8, a mesh tarp 284 can be attached to the beams 24. The tarp 284 has a tarp sleeve 286 along each of two opposing edges of the tarp 284. The tarp sleeves 286 have a slightly larger diameter than the diameter of the beams 24.

In the preferred embodiment, the trimaran 20 embodying the present invention includes a drainage system 288. As depicted in FIG. 8, both the driver's seat 64 and the passenger seat 86 have a drain hole 290. As shown in FIG. 2, a drain tube 292 is connected to main deck 36 surrounding each drain hole 290 and the drain tubes 292 extend into the centerboard housing 154. Also depicted in FIG. 2 are blocks of styrofoam 294 that are glued to sections of the bottom 132 of the main hull 38.

As shown in FIG. 8, in the preferred embodiment, the center section 22 is 14 feet in length from front end 40 to rear end 42, as depicted in $d^2$, 29 inches wide at its approximate center, as depicted by distance $d^3$, and 25 inches wide at the transom 136, as depicted by $d^4$. The floats 26 are 11 feet, 6 inches, long and 12 inches wide at the center, as depicted by $d^5$ and $d^6$, respectively, and the centerboard 152 is 46 inches long, as depicted by $d^7$ in FIG. 2. As also shown in FIG. 2, the height of the driver's seat 64 from the bottom 132 of the main hull 38, as depicted by $d^8$, is 10 inches, the height of the rear sleeve 106 from the bottom 132 of the main hull 38, as depicted by $d^9$, is approximately 18 inches, and the height of the front sleeve 126 from the bottom 132 of the main hull 38, as depicted by $d^{10}$, is also approximately 18 inches. The beams 24 all have a diameter of approximately 3 inches and have ⅛ inch walls, and the rear, front and float sleeves 106, 126, and 264, all have a diameter of approximately 3½ inches and have ¼ inch walls. The sleeves 106, 126, and 264, can have an inside diameter that is 0.020 to 0.060 of an inch larger than the outside of the beams 24, but preferably the difference is 0.040 of an inch. The long beams 274 have a length of 10 feet and the short beams 276 have a length of 4 feet, as depicted by $d^{11}$ in FIG. 8, and $d^{12}$ in FIG. 9, respectively.

The trimaran 20 embodying the present invention, can be transported in at least one of two ways. First, the center section 22, floats 26, the long beams 274, and disassembled sail assembly 28 can be transported as separate units and assembled on the waterfront. Because the separate units of the preferred embodiment are relatively light, two individuals can easily carry each element if the waterfront is near. If the distance to be covered is too far, the individual elements can be loaded into a truck and/or trailer 295 to be driven to the waterfront.

A second method for transporting the trimaran 20 is to assemble it in its trailering configuration, if it is not already so assembled. In its trailering configuration, as depicted in FIG. 9, a short beam 276 is inserted into the rear sleeve 106, a short beam 276 is inserted into the front sleeve 126, and the ends of the short beams 276 are inserted into the float sleeves 264. The beams 276 are retained in the sleeves 106, 126, and 264 by the retaining pins 280 and cotter keys 282. The sail assembly 28 and long beams 274 can then be lashed to the trimaran 20 or secured separately on a trailer 295. In this configuration the trimaran 20 can be loaded onto the trailer 295 (or it can be assembled on a trailer 295) and driven to the waterfront where it can be unloaded.

Once at the waterfront, the short beams 276 are replaced with the long beams 274, and the trimaran 20 is ready for sailing. If tarps 284 are to be attached to the beams 274, the tarp sleeves 286 are slid on to the long beams 274 before the ends of the long beams 274 are slid into the float sleeves 264. The trimaran 20 can be used with one tarp 284 as depicted in FIG. 1, two tarps 284 as depicted in FIG. 8, or no tarps 284. If attached they can be used to carry additional passengers and/or for sunbathing. Once the long beams 274 have been pinned in place the user can assemble the sail assembly 28 which includes placing the mast 244 on the mast trunk 242, and attaching the main sheet rope 254 to the rear bulkhead rope 112 and passing the other end through the main sheet jam cleat 256. The trimaran 20 can now be launched into the water.

Sitting in the driver's cockpit area 62 the user's legs are on either side of the steering wheel binnacle 72. The steering wheel 210 and the driver's seat 64 are in a car-like relationship so that the user can readily learn to steer the trimaran 20. When the steering wheel 210 is turned to the right, the trimaran 20 goes to the right. All of the other controls, such as main sheet rope 254 and the centerboard cable 196, are within the near vicinity of the steering wheel 210. The position of the boom 246 and the centerboard 152 are maintained by the locking action of the mainsheet jam cleat 256 mounted on the top panel 76 of the steering wheel binnacle 72, and the centerboard jam cleat 198 mounted on the steering wheel panel 78 on the steering wheel binnacle 72. Other controls or instrumentation can be mounted on the steering wheel binnacle 72 such as knotmeter 296 on the steering wheel panel 78, and a compass 298 on the top panel 76 as shown in FIG. 4.

When the trimaran 20 includes the alternative steering assembly 500, turning the steering wheel 508 to the right causes the vertical shaft 514 to rotate in the direction indicated by Arrow A, which causes the push/pull rod 504 to travel in the direction indicated by Arrow B. Naturally, turning the steering wheel 508 to the left causes the vertical shaft 514 and and the push/pull rod 504 to rotate and travel in opposite directions. It has been found that this alternative steering wheel 500 design gives the user a "feel" that more closely resembles the "feel" of using a tiller.

In its up position, as depicted in phantom FIG. 2, the centerboard 152 is carried within the trunk section 164 of the centerboard housing 154. The centerboard 152 is gravity actuated. By releasing the grip of the jam cleat 198 on the centerboard cable 196, the cable 196 can be feed through the jam cleat 198, thereby allowing the centerboard 152 to pivot at the pivot bolt 186 to its down or sailing position. In its sailing position, the free end 158 of the centerboard 152 extends below the main hull 38 as further depicted in FIG. 2. The kick-up rudder 230 is also gravity actuated and stays in its down position unless biased upwardly, for example when the trimaran 20 is pulled up on land.

If water splashes over the splash rails 96, it runs down to the low point of the driver's seat 64 and/or passenger's seat 86, into the drain holes 290, down the drain tubes 292 and into the centerboard housing 154. The water then flows out of the centerboard housing 154 through the slot 146 of the main hull 38. If water does enter the main hull 38, the blocks of styrofoam 294 will keep the trimaran 20 afloat.

Fiberglass is the preferred material for forming the main hull 38, float hulls 258, main deck 36, float decks 260, centerboard housing 154, centerboard 152, rudder head 228, and kick-up rudder 230, but any suitable material, e.g. wood or other composite materials can be used. Marine aluminum is the preferred material for forming the beams 24, mast sleeve 34 mast trunk 242 and sleeves 106, 126, and 264, but any suitable material, e.g. stainless steel can be used. Stainless steel is the preferred material for the fastening hardware, such as the beam pins 280, rudder bolt 236, and centerboard pivot bolt 186, but any suitable material can be used.

A number of variations of the present invention can be made. For example, alternative embodiments of the present invention could include a trimaran 20 with one pair of fixed beams 24, fixed beams 24 with telescopic members, or beams 24 of different lengths than those used in the preferred embodiment. By way of further example, rather than being 10 feet long, the long beams 274 could be 7 feet 6 inches long. This would allow the user to transport the trimaran 20 in its sailing configuration on a full size trailer. Still another embodiment could include a pivoting centerboard 152 that is spring actuated rather than gravity actuated. Although steering assembly 32 in the preferred embodiment includes a steering wheel 210, the steering assembly 32 could comprise a tiller. Yet another alternative embodiment could include a center section 22 and floats 26 that are each one piece and have hull and deck portions.

FIGS. 11–20 represent a still further embodiment of the present invention. The trimaran 600 of this alternative embodiment broadly includes a center section 602, two floats 604, four beams 606, a sail assembly 608, a daggerboard 610, a steering assembly 612, and eight beam adjustment pads 613. The steering assembly 612 in the preferred embodiment of this alternative trimaran embodiment 600 consists of the steering wheel assembly 500, the push/pull rod 504 and the rudder assembly 208 discussed above. The sail assembly 608 is a slightly smaller version of the sail assembly 28 also discussed above.

Figure 14:
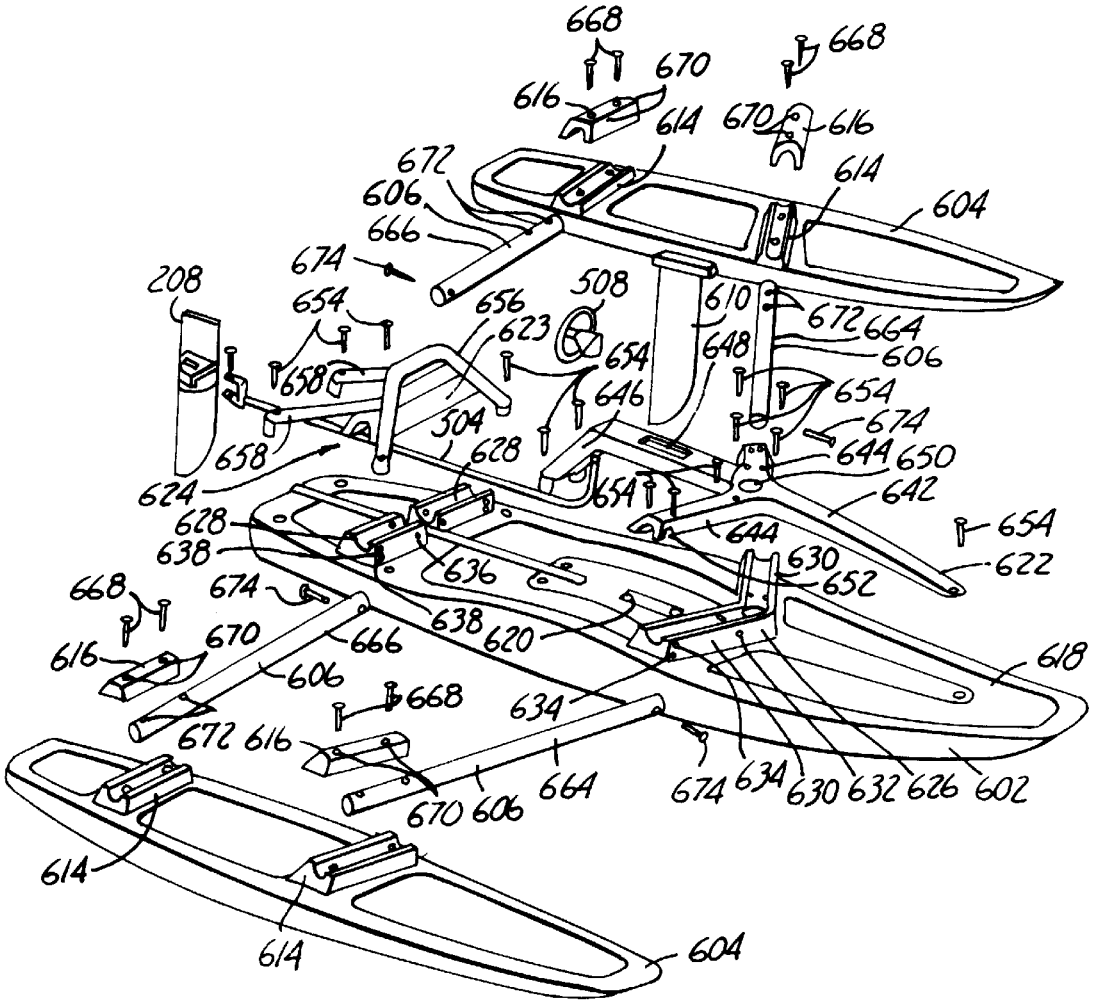
FIG. 14 is an exploded view of the trimaran of FIG. 11.

As best seen in FIG. 14, the floats 604 resemble surfboards and each float 604 includes two molded protrusions 614 and two beam caps 616, each having a generally semicircular inner surface adapted for receiving a beam 606. The center section 602 includes a dominant hull 618 having a dagger board slot 620, a small front deck 622, a smaller rear deck 623 and a seat assembly 624. Like the floats 604, the hull 618 resembles a surfboard and includes one V-shaped molded protrusion 626, and two straight molded protrusions 628, each having a generally semicircular inner surface adapted for receiving one or more beams 606. The V-shaped molded protrusion 626 includes two cradle portions 630. Each cradle portion 630 has a pivot hole 632 and two beam adjustment holes on each side 634, and has a ⅛ inch rubber liner 633. Similarly, each straight molded protrusion 628 has a pivot hole 636 and two beam adjustment holes 638 on each side, and has a ⅛ inch rubber liner 637. In the preferred embodiment, the floats 604 and the hull 618 are urethane foam filled with a polyethylene rotational molded skin.

With further reference to FIG. 14, the front deck 622 includes a longitudinal body portion 642, two arm portions 644 and a steering wheel base portion 646. The body portion 642 has a slot 648 for receiving the daggerboard 610, and a mast aperture 650. The arm portions 644 each have a ⅛ inch rubber liner 635, a generally semicircular inner surface adapted for receiving a beam 606, and one beam adjustment hole 652 on each side. The front deck 622 is connected to the hull 618 with deck screws 654 or other mechanical fasteners. It should be understood that the front deck 622 could be chemically bonded to the hull 618.

The seat assembly 624 includes a backrest frame 656 for attaching webbing, canvas or the like, and two back rest supports 658. The rear deck 623 is rigidly attached to the backrest frame 656 and back rest supports 658. Like the front deck 622, the seat assembly 624 is connected to the hull 618 with deck screws 654 or other mechanical fasteners, but could be chemically bonded to the hull 618, or could be adjustably mounted on a frame that is connected to the hull 618. Like the arm portions 644 of the front deck 622, the rear deck 623 has two ⅛ inch rubber liners 625, a generally semicircular inner surface for receiving two beams 606 (one corresponding to each of the straight molded protrusions 628), and one beam adjustment hole 662 on each side.

Figure 15:
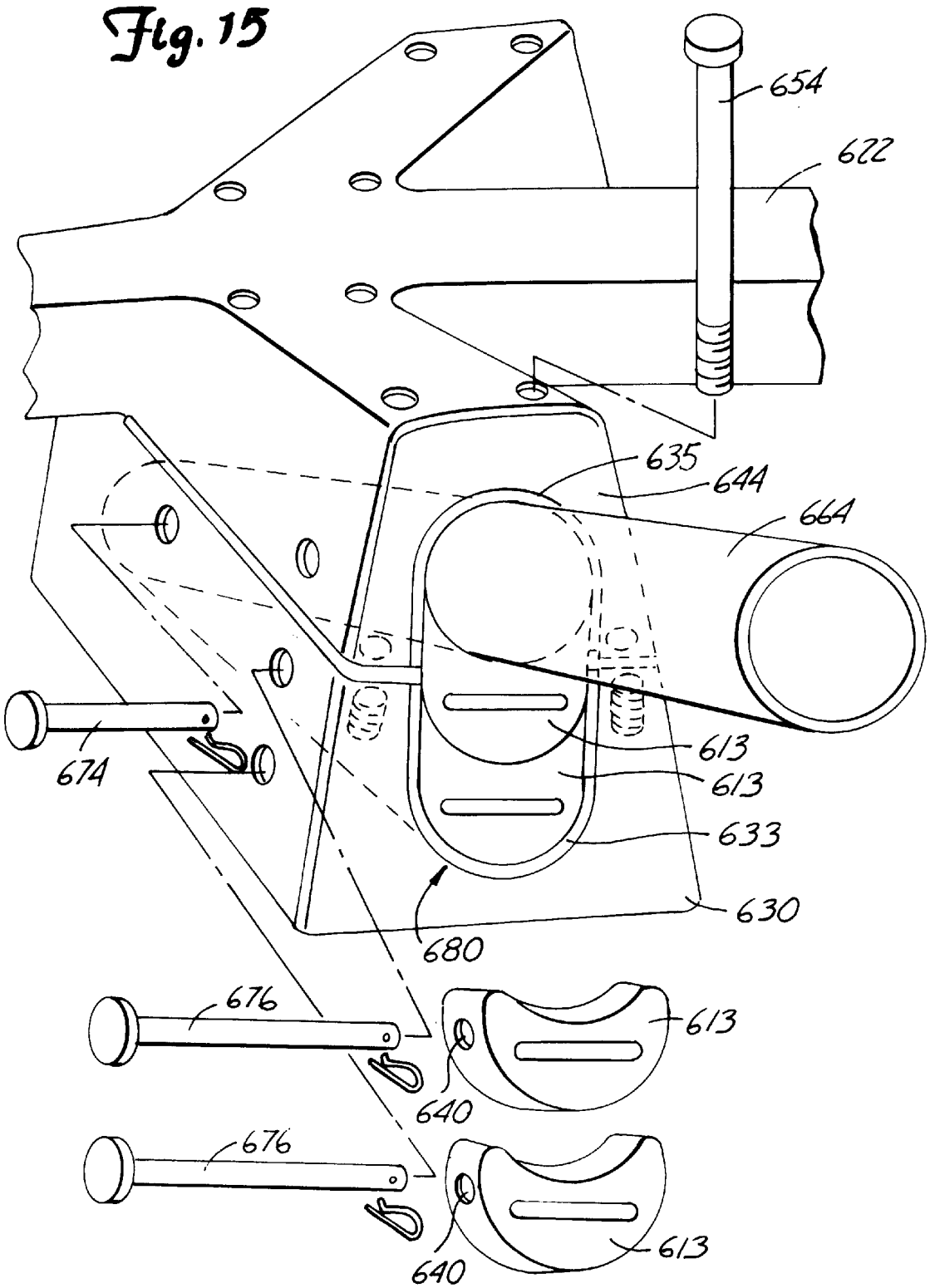
FIG. 15 is a fragmentary isometric view of the collar area of the center section of the trimaran of FIG. 11 showing a front beam and adjustment pads as they are configured when the front beam is held in the high position.
Figure 16:
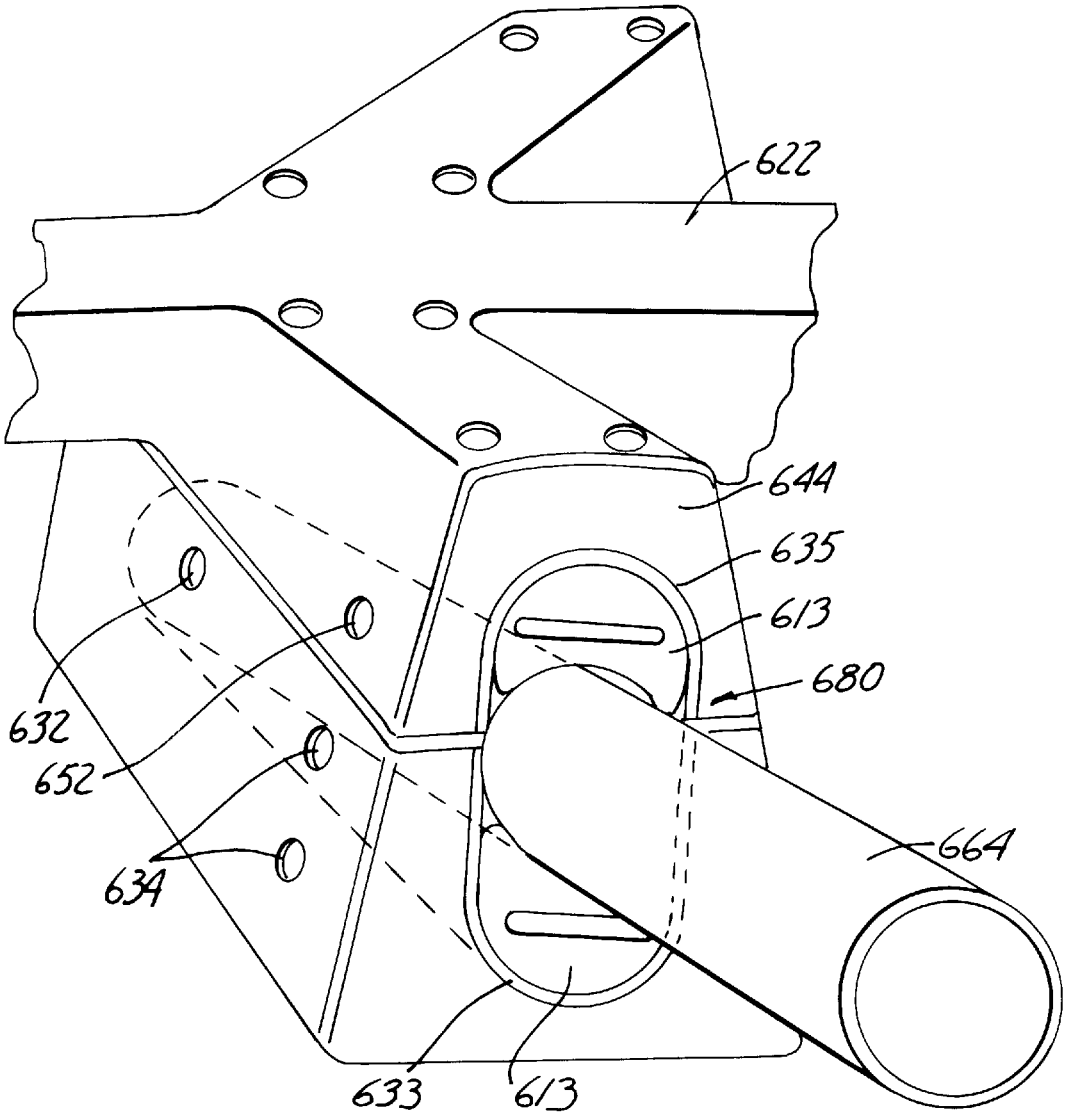
FIG. 16 is a fragmentary isometric view of the collar area of the center section of the trimaran of FIG. 11 showing a front beam and adjustment pads as they are configured when the front beam is held in the medium position.
Figure 17:
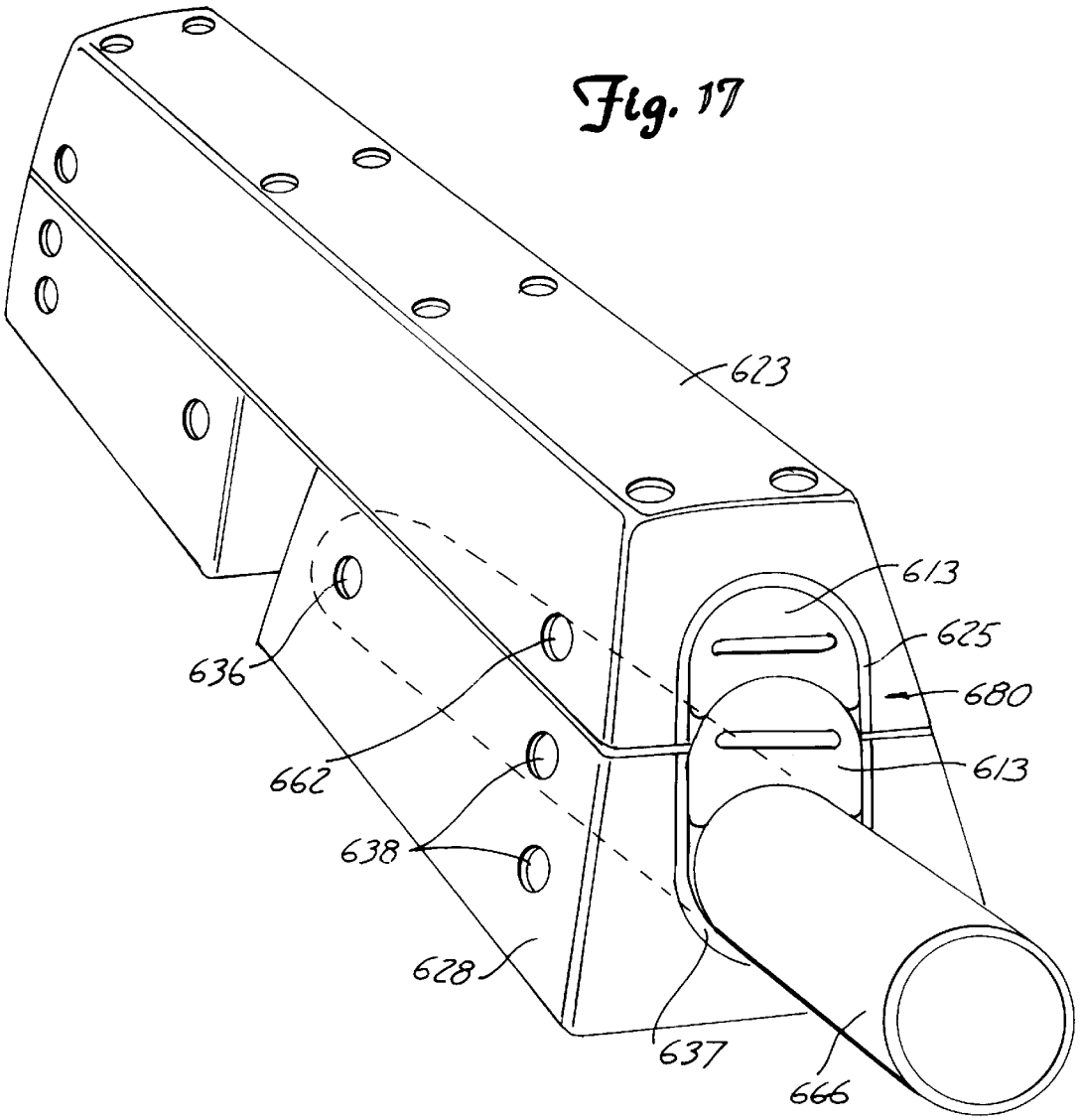
FIG. 17 is a fragmentary isometric view of the collar area of the center section of the trimaran of FIG. 11 showing a rear beam and adjustment pads as they are configured when the rear beam is held in the low position.

The adjustment pads 613 are generally arcuate shaped, and are made from rubber, urethane or other material that can compress slightly. The pads 613 are shaped so they fit within the generally semicircular inner surfaces formed by the two molded protrusions 628, the rear deck 623, the cradle portions 630, and the arm portions 644, and so that they also have a surface that mates with a beam 604 as depicted in FIGS. 15–17. Each pad 613 has cylindrical hole 640 that extends through it for receiving an adjustment pin 676, other rod-like connector.

The trimaran 600 includes four beams 606; two front beams 664 and two rear beams 666. Each beam 606 is removably connected to one side of the center section 602 and to a float 604. The beams 606 are removably connected to the floats 604 with beam cap screws 668, or other mechanical fasteners, that pass through apertures 670 in the beam caps 616, through apertures 672 in the beams 606, and screws into screw inserts in the molded protrusions 614.

The beams 606 are removably and adjustably connected to the center section 602 with pins or other rod-like connectors, or other mechanical fasteners, and by the adjustment pads 613. Each front beam 664 and rear beam 666 is connected to the center section 602 with a pivot pin 674. For example, as seen in FIG. 15, each front beam 664 is connected to a cradle portion 630 by a pivot pin 674 that passes through pivot holes 632 and apertures 672 in the beam (shown in FIG. 14). Each front beam 664 is further connected to the center section 602 by the compression forces created by the adjustment pads 613 and the front beam 664 being confined within the space created by the cradle portion 630 of the V-shaped protrusion 626, and the arm portion 644 of the front deck 622. The same configuration exists with respect to each rear beam 666. As discussed above, each straight molded protrusion 628 has a set of pivot holes 636 and two sets of adjustment holes 638, and the rear deck 623 has one set of beam adjustment holes 662 for retaining adjustment pads 613.

The area of the cradle portion 630 and the arm portion 644, and the area of the straight molded protrusions 628 and rear deck 623, which are lined by liners 625, 633, 635 and 637, and within which the beams 606 and adjustment pads 613 are compressed, will hereinafter be referred to as a "collar" 680. Accordingly, the center section 602 has four collars 680, and when the trimaran is in use, each collar 680 defines the compression space for two adjustment pads 613 and one beam 606.

As described above, in the preferred embodiment the adjustment pads 613 are retained by adjustment pins 676, but the beams are not further connected with an adjustment pin 676. (The only pinned connection to the center section 602 is with pivot pins 674). It should be understood that the beams 606 also could have an aperture for receiving an adjustment pin 676. The beams 606 would then be retained by pivot pins 674, adjustment pins 676, and the compression forces created by the adjustment pads 613 and the beams 606 being confined within the collars 680.

Because there are three sets of apertures (see FIG. 15), three settings are available; low, medium and high. FIG. 15 shows two adjustment pads 613 to be retained in the cradle portion 630 by adjustment pins 676, and the front beam 664 being directly compressed by an adjustment pad 613 against the liner 635 of the arm portion 644 (or top of the collar 680). FIG. 15 depicts the adjustment pads 613 supporting the front beam 664 in the high position. Accordingly, to adjust the front beam 664 so it is in the medium position one adjustment pad 613 would be removed and replaced above the front beam 664, and the adjustment pin 676 would be placed through the top adjustment hole 652 in the arm portion 630, as shown in FIG. 16. FIG. 17 depicts a rear beam 666 in the low position. In the low position the rear beam 666 is compressed against the liner 637, by two adjustment pads 613; one to be retained in the straight protrusion 628 by an adjustment pin 676, and one to be retained in the rear deck 623 by an adjustment pin 676. The pins 674, 676 are held in place by cotter pins or a similar retaining devices.

The trimaran 600 of this alternative embodiment is used much like the trimaran 20 described above. The user sits in front of the steering wheel 508 and is able to control the daggerboard 610 and sail assembly 608 from his or her seated position. The beams 606 are quickly and easily removed from and connected to the floats 604 and center section 602 for transporting it to and from the waterfront.

Figure 18:
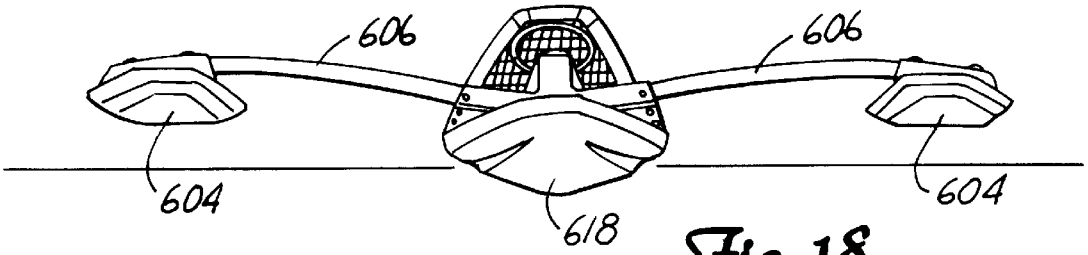
FIG. 18 is a front view of the trimaran of FIG. 11 with the beams held in the high position.
Figure 19:
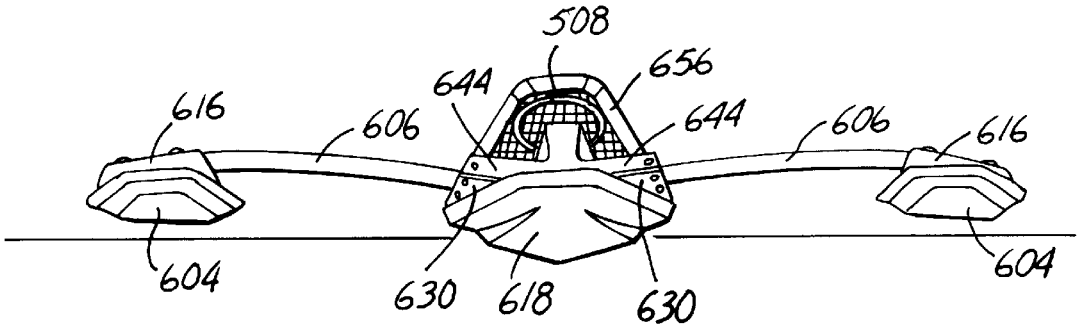
FIG. 19 is a front view of the trimaran of FIG. 11 with the beams held in the medium position.
Figure 20:
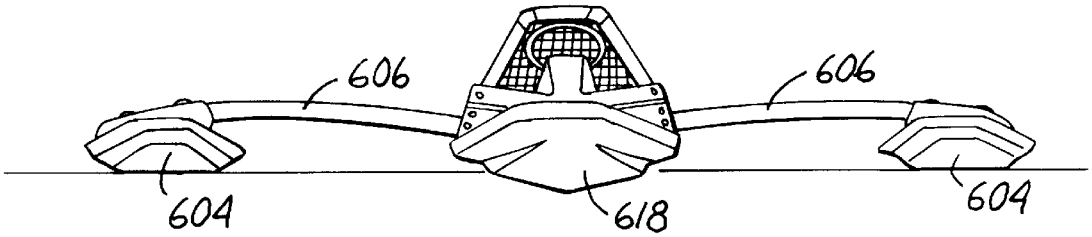
FIG. 20 is a front view of the trimaran of FIG. 11 with the beams held in the low position.

The user is able to use the different beam 606 height settings (low, medium and high) to meet his or her needs in terms of sailing capabilities, weather conditions, or to achieve the feel of sailing a monohull sailboat. For example, a beginner would probably want to attach the beams 606 to the hull 618 in their low position, as depicted in FIG. 20 (see also FIG. 17). In the low position the floats 604 are in full contact with the water stabilizing the trimaran 600. In the medium position, as depicted in FIG. 19 (see also FIG. 16), the floats 604 will be in partial or no contact with the water depending on wave conditions and depending on the user's ability to keep his or her weight centered, and thus the trimaran 600 centered. Because the drag of the floats 604 will be somewhat reduced or eliminated, the trimaran 600 will be faster and more maneuverable. FIG. 18 depicts the beams 606 set in the high position and corresponds to FIG. 15. In the high position the floats 604 will be off the water unless the user comes about (turns) hard or begins to tip. In the high position the user can obtain maximum speed and maneuverability, as the trimaran 600 has fewer hulls (only one) in the water creating drag.

It should be understood that the settings (high, medium and low), must be the same for one float 604 (e.g. the right float must have both beams set in the high position), but that both floats 604 do not need to be set at the same height. (One float may be in the high position, and the other float in the low position. In this configuration, one float would be in the water and one would be out of the water).

Another feature of the adjustment pads 613 (in addition to compressing the beams 606 within the collars 680) is that they function as "shock absorbers". The compressible adjustment pads 613 absorb shock and vibrations transferred from the floats 604 to the beams 606.

In the preferred embodiment, the center section 602 of the trimaran 600 is approximately 12 feet long, 24 inches wide and 6 inches thick. The floats 604 are approximately 8 feet long, 18 inches wide and 4 inches thick.

It should be understood that features of the various embodiments disclosed herein could be used to configure a trimaran that utilizes some of the features of each. For example the steering wheel assembly 204 could be used with trimaran 600. By way of further example, trimaran 20 could be modified to include adjustment pads 613.

Although a description of the preferred embodiment has been presented, it is contemplated that various changes, including those mentioned above, could be made without deviating from the spirit of the present invention. Accordingly, it is intended that the scope of the present invention be dictated by the appended claims rather than by the description of the preferred embodiment.

What is claimed is:

1. A trimaran comprising:

two floats;

at least four beams each having a first end and a second end, said first end of each said beam removably connected to a said float:

a main section including a hull and deck and said second end of each said beam adjustably and removably connected to said main section, said hull including at least two protrusions each having a generally semicircular inner surface which are adapted for receiving said beams, and said deck including members having a generally semicircular inner surface which are adapted for receiving said beams, said members corresponding and removably connected to said protrusions;

a sail assembly removably connected to said hull and said deck; and a steering assembly connected to said hull and said deck.

2. The trimaran of claim 1, wherein each beam includes at least two sets of apertures, and wherein one set of said at least two sets of apertures are adjacent said first end of said beams, and wherein another set of said at least two sets of apertures are adjacent said second end of said beams, and further wherein said protrusions include four sets of pivot holes, and at least four sets of adjustment holes.

3. The trimaran of claim 2, wherein said members include at least four sets of adjustment holes.

4. The trimaran of claim 3, wherein said trimaran further comprises a plurality of adjustment pads, and a plurality of pins for connecting said pads and said beams to said main section.

5. The trimaran of claim 4, wherein at least one said adjustment pad and said second end of each said beam is retained between each said protrusion and each said member by at least one of said plurality of pins, and said second end of each said beams is further pivotally connected to one of said at least two protrusions.

6. The trimaran of claim 5, wherein each said first end of said beams is removably connected to said one of said two floats.

7. A trimaran comprising:

a main section having four beam attachment assemblies, each said beam attachment assembly including a collar portion;

a plurality of compressible adjustment pads removably connected to said collar portions;

a sail assembly connected to said main section;

a steering assembly connected to said main section;

two floats; and at least four beams each having a first end and a second end, said first end of each said beam removably connected to a float, and said second end of each said beam pivotally, adjustably and removably connected to said beam attachment assemblies, and in contact with at least one said compressible adjustment pad.

8. The trimaran of claim 7, wherein the beams can be adjusted by reconfiguring said compressible adjustment pads within said collar portions so that the height of each said float can be independently varied relative to the height of the main section.

9. The trimaran of claim 8, wherein each said beam attachment assembly further includes a pivot portion, and said trimaran further comprises a plurality of adjustment pad retaining pins and a plurality of pivot pins, and wherein said second end of each said beam is pivotally and removably connected to said pivot portion by one said pivot pin.

10. A trimaran comprising:

a main section having four beam attachment assemblies, each said beam attachment assembly including a collar portion having multiple adjustment apertures, and a pivot portion having two pivot apertures, a plurality of adjustment pads, a plurality of adjustment pad retaining pins and a plurality of pivot pins, said adjustment pads being removably connected to said collars;

a sail assembly removably connected to said main section;

a steering assembly connected to said main section;

two floats; and at least four beams each having a first end and a second end, said first end of each said beam removably connected to a said float, said second end of each said beam pivotally and removably connected to said pivot portion by said pivot pin, and compressed within one said collar by said adjustment pads, and further said beams being adjustably connected to said beam attachment assemblies whereby the beams can be adjusted so that the height of each said float can be independently varied relative to the height of the main section.

11. The trimaran of claim 10, wherein said beams can be adjusted so that one said float is elevated above the water when said trimaran is afloat, and the other said float is in contact with the water.

12. A multi-hull boat comprising:

at least two hulls, at least one of said at least two hulls including at least two beam attachment assemblies, each said beam attachment assembly including a collar portion;

at least two compressible adjustment pads, at least one of said at least two compressible adjustment pads removably connected to each said collar portion of said at least two beam attachment assemblies; and at least two beams having a first end and a second end, said first end of each said at least two beams in direct contact with at least one compressible adjustment pad whereby said one compressible adjustment pad holds each said beam in position, said second end of each said at least two beams connected to a second of said at least two hulls.

13. The boat of claim 12, wherein the first end of each of said at least two beams is in contact with two said compressible adjustment pads.

14. The boat of claim 12, wherein the at least two compressible adjustment pads are used to adjust the height of the hull connected to said second end of said beam relative to the hull including said at least two beam attachment assemblies.

* * * * *